US007061438B2

(12) United States Patent
Aquino

(10) Patent No.: US 7,061,438 B2
(45) Date of Patent: Jun. 13, 2006

(54) RADIO-CONTROL ANTENNA SUPPORT ARM FOR LIFTING MACHINERY

(75) Inventor: Francois Aquino, Pouilly-Sous-Charlieu (FR)

(73) Assignee: Potain, Ecully (FR)

( * ) Notice: Subject to any disclaimer, the term of this patent is extended or adjusted under 35 U.S.C. 154(b) by 120 days.

(21) Appl. No.: 10/665,306

(22) Filed: Sep. 22, 2003

(65) Prior Publication Data

US 2004/0095285 A1 May 20, 2004

(30) Foreign Application Priority Data

Oct. 10, 2002 (FR) ..... 02 12608

(51) Int. Cl.
*G08B 21/00* (2006.01)

(52) U.S. Cl. ..... 343/713; 340/267 C; 343/874

(58) Field of Classification Search ..... 343/713, 343/815, 819, 821, 874; 212/160, 270, 159, 212/206, 39 P; 182/2.11, 69.4, 2.1–2.9; 340/267 C, 258 D See application file for complete search history.

(56) References Cited

U.S. PATENT DOCUMENTS 2,789,282 A 4/1957 Winters ..... 340/660
3,833,898 A * 9/1974 Wilkinson ..... 212/280
4,179,233 A * 12/1979 Bromell et al. ..... 414/138.3
4,329,692 A * 5/1982 Brunner ..... 343/780
4,607,389 A * 8/1986 Halgrimson ..... 455/11.1
4,721,213 A * 1/1988 Eitel ..... 212/285
4,779,712 A 10/1988 Petercsak ..... 188/379
5,205,544 A * 4/1993 Kroeger ..... 254/329
6,256,983 B1 * 7/2001 Yasui ..... 60/285
6,276,488 B1 * 8/2001 Divine et al. ..... 182/2.11
6,474,922 B1 * 11/2002 Bachman et al. ..... 414/21
6,597,062 B1 * 7/2003 Li et al. ..... 257/686
6,677,914 B1 * 1/2004 Mertel ..... 343/815

FOREIGN PATENT DOCUMENTS

EP 1149796 A2 10/2001

* cited by examiner

*Primary Examiner*—Don Wong
*Assistant Examiner*—Chuc Tran
(74) *Attorney, Agent, or Firm*—Oliff & Berridge, PLC

(57) ABSTRACT

The invention relates to radio-control of lifting machinery, and is intended to solve problems due to the presence of interfering metal masses. For this purpose, the support arm of the radio-control antenna is mounted such that it is able to be orientated about a vertical pivoting axis, on the lifting, machinery. This support arm includes a head, radially offset with respect to the axis, upon which the antenna is mounted. The support arm can occupy separate angular positions, and in particular a position in which the antenna is separated from the metal structure of the lifting machinery. This invention applies in particular to the radio-control of tower cranes.

16 Claims, 5 Drawing Sheets

RADIO-CONTROL ANTENNA SUPPORT ARM FOR LIFTING MACHINERY

The present invention relates generally to the field of radio-controlled lifting machinery. This invention relates more particularly to a multiple-position radio-control antenna support arm for lifting machinery. The invention applies in particular, but not exclusively, to the radio-control of tower cranes.

BACKGROUND

For the radio-control of tower cranes, such as known for example from the European patent EP 1149796 A2 in the name of the Applicant, there are receiving or receiving and transmitting antennas for control signals. These antennas are either fixed antennas or detachable antennas.

When they are fixed, the radio-control antennas are directly fired to a point in the framework of the crane, or they are incorporated with a receiver or transceiver unit for control signals, this unit itself being fixed to the crane. The fixed antennas thus have a unique and non-modifiable position.

When they are detachable, the radio-control antennas are generally fixed:

- either to a receiver or transceiver unit for control signals, which can itself be fixed to the crane at various locations specially provided for this purpose or not;
- or on a magnetic or non-magnetic mount, with a sufficient length of transmission cable or with detachable cable extensions, it being possible to position the mount on the crane at various locations specially provided for this purpose or not.

Radio-control is always interfered with by the metal obstacles located between the transmitter and the receiver of the control signals, these obstacles reducing the range of the radio control and creating echoes. Furthermore, the quality of the transmission of the control signals is greatly affected by the length of cable which connects the antenna to the receiver, by the connections associated with the cable extensions and by the quality of the electrical ground between the antenna and its support, if the antenna is detachable.

More particularly, systems with a fixed antenna or fixed antennas, having a unique position, are subjected to metal obstacles and principally to the framework of the crane itself, especially during its rotation.

Systems with a detachable antenna or detachable antennas are subjected to even more diverse factors:

- difficulty with cable passages;
- long transmission cable length, which must be provided for the most distant position of the antenna;
- interference due to the poor quality of the electrical connections, in the case of the use of cable extensions;
- frequent electrical ground continuity faults;
- risk of damage to the transmission cable, whilst the crane is working, for example due to projections, shocks and climatic conditions.

SUMMARY

The purpose of the present invention is to avoid the drawbacks of the various current types of fixed or detachable radio-control antennas, associated with their positioning, by providing a system making it possible to position the receiving or receiving and transmitting antenna optimally in such a way as to reduce the influence of metal obstacles on the electromagnetic waves, whilst protecting the cables and minimizing the other types of interference in order to optimize the functioning of the radio-control.

For this purpose, the invention essentially relates to a radio-control antenna support arm for lifting machinery, in particular for a tower crane, the support arm able to be orientated about a vertical pivoting axis on the lifting machinery such that it can occupy at least two separate angular positions, and this support arm comprising a head, radially offset with respect to the said pivoting axis, upon which is mounted at least one radio-control antenna.

In one embodiment of this support arm able to be orientated, the latter comprises a base part mounted such that it rotates on a fixed pivot, defining the said vertical pivoting axis, a curved or bent tube extending the base part and, at the end of the tube, a head in the form of a mounting plate, offset with respect to the said pivoting axis and upon which the radio-control antenna is mounted, a transmission cable which ends at this antenna passing through the inside of the tube, and means being provided for positioning the tube in at least two predefined separate angular positions.

The angular positions, in which the support arm or its tube can be immobilized, advantageously comprise a position folded back against the lifting machinery, such as a crane, and at least one position separated from the metal structure of that lifting machinery. In particular, in the case of a folding tower crane, the radio-control antenna support arm is mounted such that it can be orientated on a lower chassis or frame of the crane, and the predefined angular positions of this support arm comprise:

- a first position, folded back against the lower frame or chassis of the crane, this position being usable for the working of the crane and also for its transport in the folded state;
- a second position, separated from the lower frame or chassis of the crane, this position being usable for raising and lowering of the crane; and
- at least a third position, separated from the lower frame or chassis of the crane, this position bringing the antenna toward the front of the lower frame or chassis, or in front of the base of the crane's mast.

For example, the angular distance between the first position of the support arm and its second position is in this case about 60° and the angular distance between the second position of the support arm and its third position and, if applicable, between the following positions, is also about 60°, the support arm thus having, for example, an angular positional range of the order to 120°.

For the positioning of the antenna support arm in its first position, folded back against the lower frame or chassis of the crane, in a particular embodiment there is provided an upper positioning pin held on a plate fixed to the said frame or chassis, this pin cooperating with another plate, provided with a hole, attached to the support arm's head in the form of a mounting plate.

For the positioning of the antenna support arm in its other two or more positions, separated from the lower frame or chassis of the crane, there is provided, for example, in the base part and at the fixed pivot of the support arm, a lower positioning pin attached to the base part of the support arm and provided for cooperating with one or other of two or more holes drilled in a plate integral with a part of the fixed pivot.

This fixed pivot, used for the orientation of the antenna support arm, can be produced in the form of a sheet, folded into a U shape, whose flanges are positioned horizontally, one above the other, in such a way as to form an upper bearing and a lower bearing, traversed by the base part of the support arm, the said plate drilled with two or more holes being integral with the upper flange of the folded sheet which forms the upper bearing.

In this way a radio-control antenna support arm is obtained which allows the antenna to be positioned in an optimum receiving or receiving and transmitting position (depending on the type of antenna in question), with respect to a portable control unit used by the operator. In particular, the antenna can be moved into an optimal position which is the one making it possible to reduce the influence of the metal obstacles that are part of the crane itself or the operating site of that crane, and able to be located between the control unit carried by the operator and the receiver or transceiver unit carried by the crane.

In particular, the position separated from the lower frame or chassis of the crane, and forward with respect to the base of the crane's mast, is useful when the operator is himself located in front of the mast in order to proceed with the hooking or unhooking of loads onto or from the crane's hook.

In the application of the invention to a crane with a folding tower, the other provided positions of the support arm also meet other requirements, which are to achieve a retracted position, for the transport of the crane, and a special position in which the antenna support arm does not present an obstacle to the unfolding and folding movements during operations of raising and lowering the crane.

In addition to the separation of the antenna with respect to the metal masses of the crane, preventing interference due to electromagnetic waves, the radio-control support arm also has other considerable advantages.

In particular, the bent or curved tube of the support arm provides effective protection of the connection cable between the antenna and the receiver or transceiver unit as this cable passes though the inside of the tube. The cable is thus protected electromagnetically from any spurious transmission, which guarantees the quality of transmission and reception. Furthermore, the cable is mechanically protected in various aspects:

- the tube mechanically protects the cable from damage from external sources such as projections, shocks and bad weather,
- the cable, of minimal and constant length, runs no risk of being wound or twisted,
- there is no risk of this cable being damaged due to a change of position of the antenna,
- no disconnection of the cable, and therefore of the antenna, with respect to the receiver or transceiver unit, is necessary during a change of position of the antenna.

This results in an improvement in the quality of the electrical connection between the antenna and the receiver or transceiver unit.

Furthermore, the structure of the support arm according to the invention makes it possible to position and immobilize the antenna in the chosen position simply and quickly.

Finally, the antenna support arm according to the invention is easily adaptable to lifting machinery with metal framework other than tower cranes and for which the same problems arise when this machinery is radio-controlled.

BRIEF DESCRIPTION OF THE DRAWINGS

The invention will be better understood with the help of the following description, given with reference to the appended diagrammatic drawing showing, as non-restrictive examples, two embodiments of this radio-control antenna support arm for lifting machinery.

DETAILED DESCRIPTION OF EMBODIMENT

Figures 8, 9:
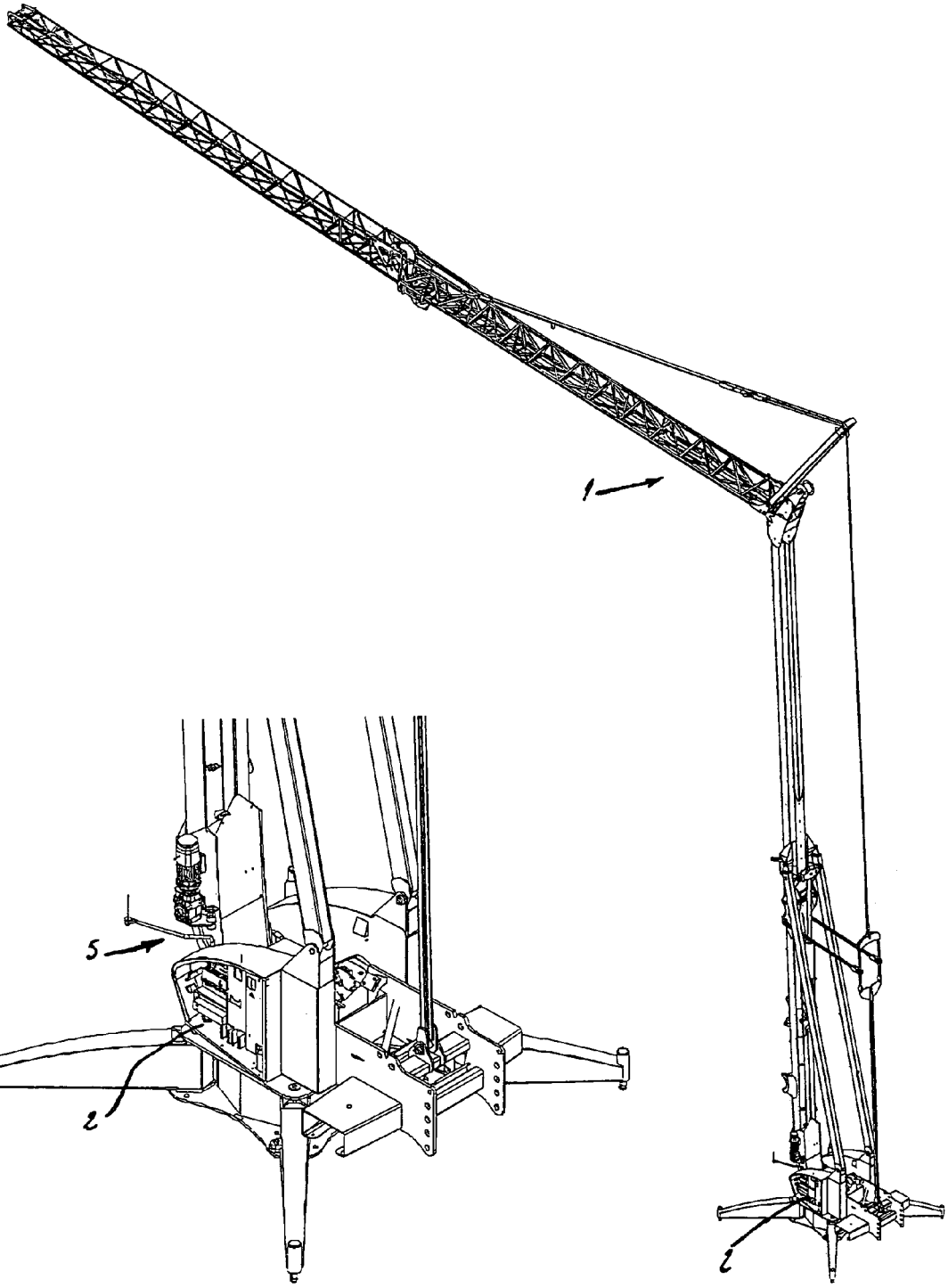
FIG. 8 is a second perspective view perspective view partially showing a tower crane equipped with the antenna support arm according to this invention.
FIG. 9 is a perspective view of a tower crane usable with the antenna support arm according to this invention.

FIGS. 1, 2, 4, 8 and 9 show a lower frame, also referred to herein as a rotating chassis 2, of a folding tower crane 1, shown in exemplary manner in FIG. 9. In an exemplary embodiment, the rotating chassis is mounted on a fixed chassis such that it can be orientated. On the rotating chassis 2 there is articulated, above a horizontal axis 3, the base of the mast 4 of the crane. A support arm 5 for a radio-control antenna 6 of the crane is mounted, such that it can be orientated, on the rotating chassis 2 and more particularly on one of two lateral parts of this chassis 2, between which the base of the mast 4 is located.

The support arm 5 comprises a base part 7 mounted on a fixed pivot 8 having a vertical axis, a curved tube 9 which extends the base part 7 upward and a head 10 carried by the top end of the tube 9.

Figure 6:
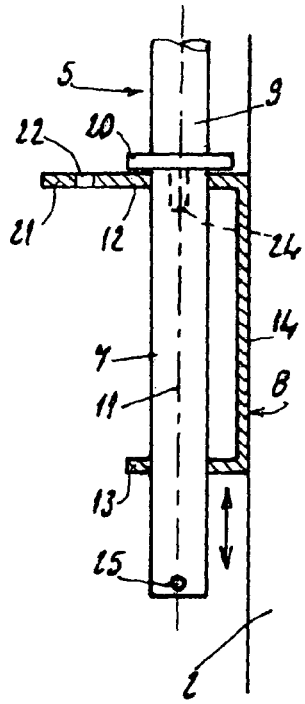
FIG. 6 is a vertical cross-sectional view of this fixed pivot, through VI—VI of FIG. 5.

The base part 7 is in the form of a section of straight tube, having a vertical axis 11, mounted such that it rotates in the fixed pivot 8—see FIG. 6 in particular.

The fixed pivot 8 is produced in the form of a sheet folded into a U shape, with a horizontal upper flange 12 and a horizontal lower flange 13, which respectively form an upper bearing and a lower bearing traversed by the base part 7 of the support arm 5. The vertical section 14 of the folded sheet, which connects its two horizontal flanges 12 and 13 is fixed, and in particular welded, against the rotating chassis 2 of the crane, on the inner side of a lateral part of the chassis 2.

The curved shape of the tube 9 brings its top end, and therefore the head 10 of the support arm 5, into a position that is clearly offset with respect to the vertical axis 11.

The top head 10 of the support arm 5 is in the form of a mounting plate or upper horizontal surface, upon which the radio-control antenna 6 is fixed vertically. This can be either a receiving-only antenna or a receiving and transmitting antenna.

The antenna 6 is connected, by a transmission cable 15, to a receiver or transceiver unit which is not shown. The cable 15 passes through the inside of the curved tube 9, which provides mechanical and electromagnetic protection to that cable 15—see FIG. 3.

Because it can be orientated about the fixed pivot 8, the support arm 5 can be put into different angular positions, corresponding with separate portions of the antenna 6 with respect to the rotating chassis 2 and to the mast 4 of the crane. These positions are, in particular, illustrated in FIGS. 1 and 4. A first position is here indicated by the reference A, in which the support arm 5 is folded back against the rotating chassis 2, and the references B and C indicate two other positions in which the support arm 5 is separated from the rotating chassis 2. The angular difference between the first position A and the second position B is about 60°. Similarly, the angular difference between the second position B and the third position C is about 60°. The angular positional range of the support arm 5 is therefore about 120°.

Means are provided for the positioning of the support arm 5 in the three positions A, B and C defined above.

Figure 1:
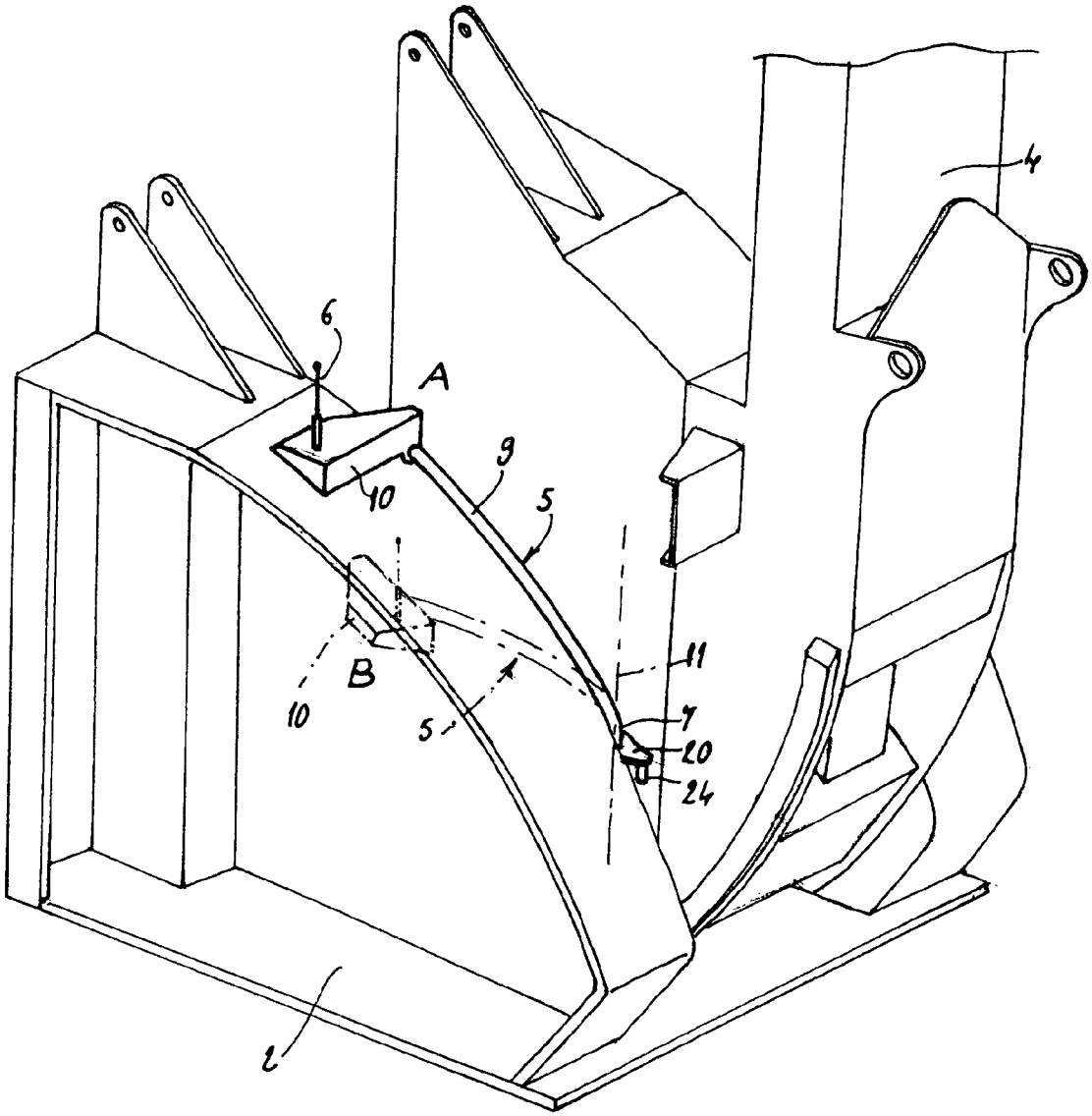
FIG. 1 is a perspective view, partially showing a tower crane equipped with the antenna support arm according to the invention, with indication of two positions of this support arm.
Figure 2:
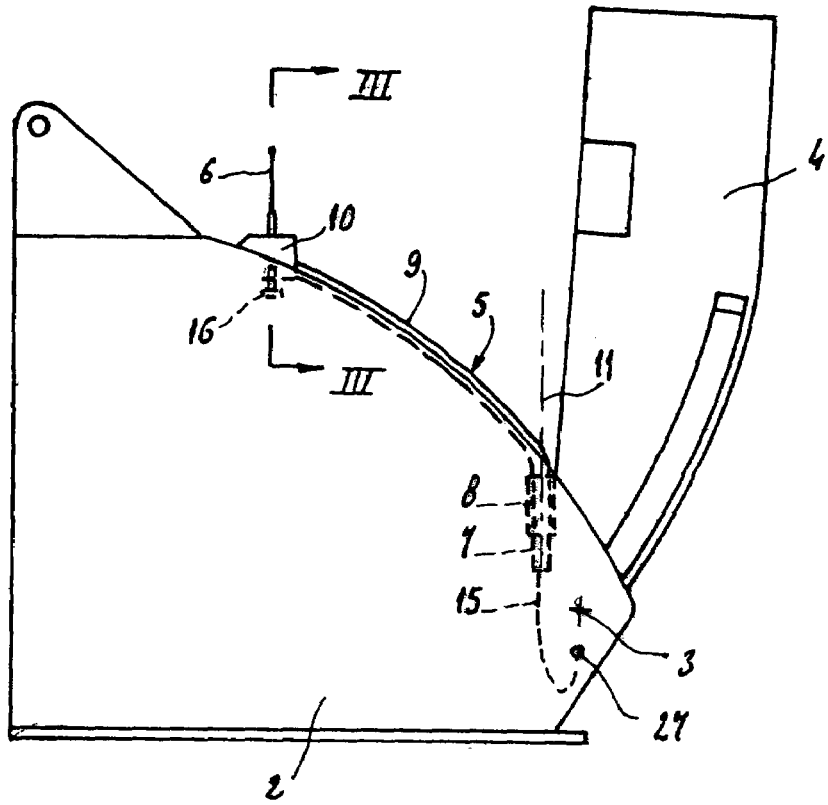
FIG. 2 is a side view of this part of the crane, with the support arm in the folded back position.
Figure 3:
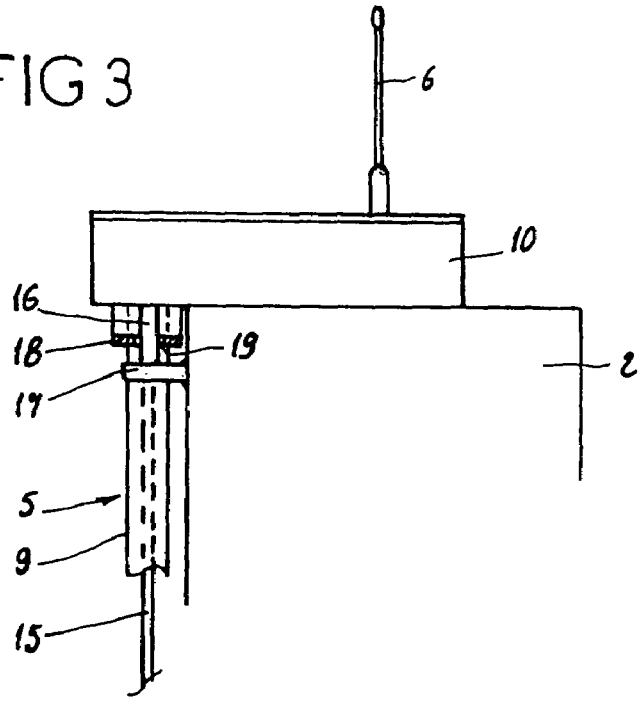
FIG. 3 is a cross-sectional view, at a larger scale, through III—III of FIG. 2, showing the upper part of the support arm and the positioning means associated with it.

For positioning the support arm 5 in the first position A, and as shown in FIGS. 2 and 3, an upper positioning pin 16 is provided, for example retained by screwing on a small horizontal plate 17 welded onto the rotating chassis 2 of the crane. The pin 16 cooperates with another plate 18, provided with an oblong hole 19, which is attached to the head 10 in the form of a mounting plate of the support arm 5, the plate 18 being welded into the lower part of the head 10.

Figure 4:
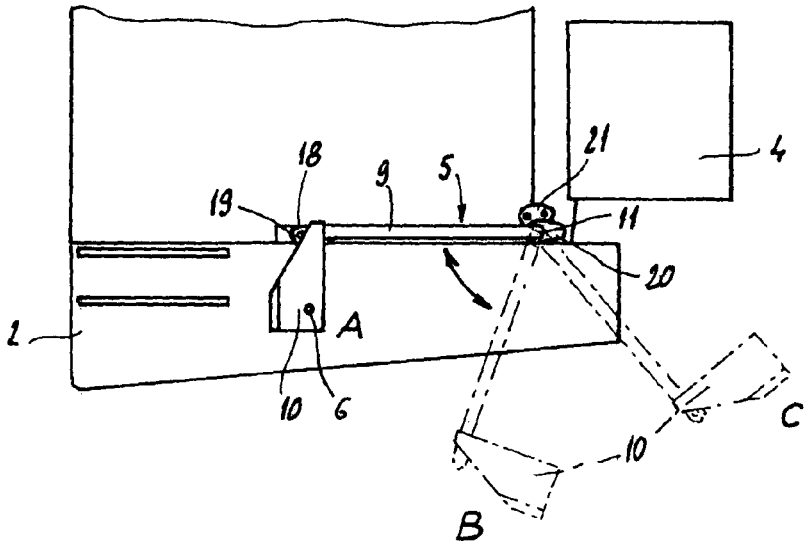
FIG. 4 is a plan view corresponding to FIG. 2, with indication of three positions of the support arm.
Figure 5:
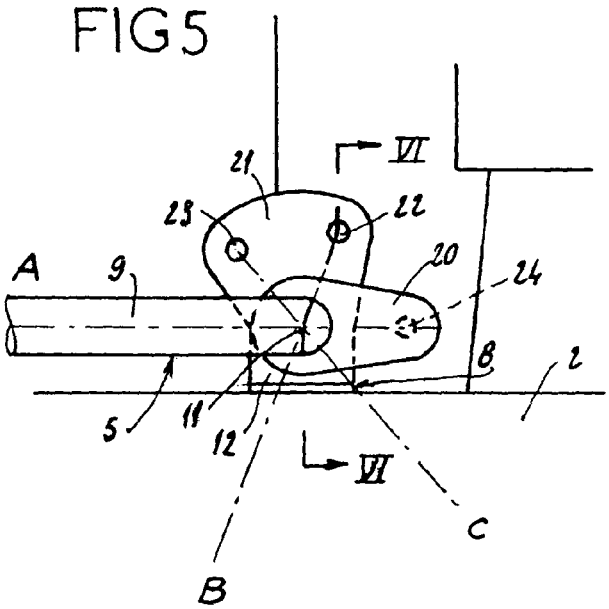
FIG. 5 is a plan view, at a larger scale, showing details of the fixed pivot of this support arm, with the associated positioning means.

For positioning the support arm 5 in the other two positions B and C, and as shown in FIGS. 4 to 6, there is provided:

- on the base part 7 of the support arm 5, a radial lug 20;
- on the fixed pivot 8, a plate 21 which extends the upper flange 12 constituting the upper bearing and which comprises two holes 22 and 23, located at equal distances from the vertical axis 11;
- and a lower positioning pin 24 attached to the radial lug 20 of the base part 7, and provided for cooperating with one or other of the two holes 22 and 23 of the plate 21.

The functioning of the support arm assembly is as follows:

In position A, the support arm 5 is folded back against the lateral part of the rotating chassis 1 of the crane. This first position, maintained by means of the upper positioning pin 16, is in particular a position for immobilizing the support arm 5 and used for transporting the crane in the folded state. It also constitutes a position that can be used for the working of the crane.

The second position B, in which the support arm 5 and the antenna 6 are separated from the chassis 2, can be used for the raising and lowering of the crane because it allows the free passage of the base of the mast 4 during its unfolding or during its folding. This second position is maintained by means of the lower positioning pin 24, inserted for this purpose in the hole 22 in the plate 21.

The third position C, in which the support arm 5 is separated from the chassis 2 and the antenna 6 is brought forward of the base of the mast 4, eliminates the possible "shadow zone" of the first position A in the case of an operator located, with his control unit, in front of the crane, close to the lifted load. This third position is maintained by means of the lower positioning pin 24, inserted for this purpose in the hole 23 in the plate 21.

It will be noted that, for the movement from the first position A to the second position B, or vice-versa, it may be necessary to raise the support arm 5 by a few centimeters, on the one hand in order to release the plate 18 from the upper positioning pin 16 and, on the other hand, to move around the obstacle formed by the upper edge of the chassis 2 of the crane. For this purpose, the base part 7 of the support arm 5 is mounted such that it slides along the vertical axis 11 in the fixed pivot 8, which makes it possible to raise the support arm 5 before rotating it and then to lower it when is has reached its new angular position. A stop device, such as a safety pin 25 is provided on the base part 7 of the support arm 5 to limit the raising of this support arm 5 and thus to prevent it from coming out of its pivot 8, particularly during a change of position of the support arm 5. The raising of the support arm 5 can also take place for the movement from the second position B to the third position C, or vice-versa.

As FIG. 2 also shows, the cable 15 forms, on emerging from the base part 7, a loop which is sufficient of allow the slight raising of the support arm 5 necessary during the change of position of this support arm. Beyond this loop, the cable 15 enters, through a passage hole 27, the rotating chassis 2 which here constitutes the frame of the crane's electrical cabinet.

Figure 7:
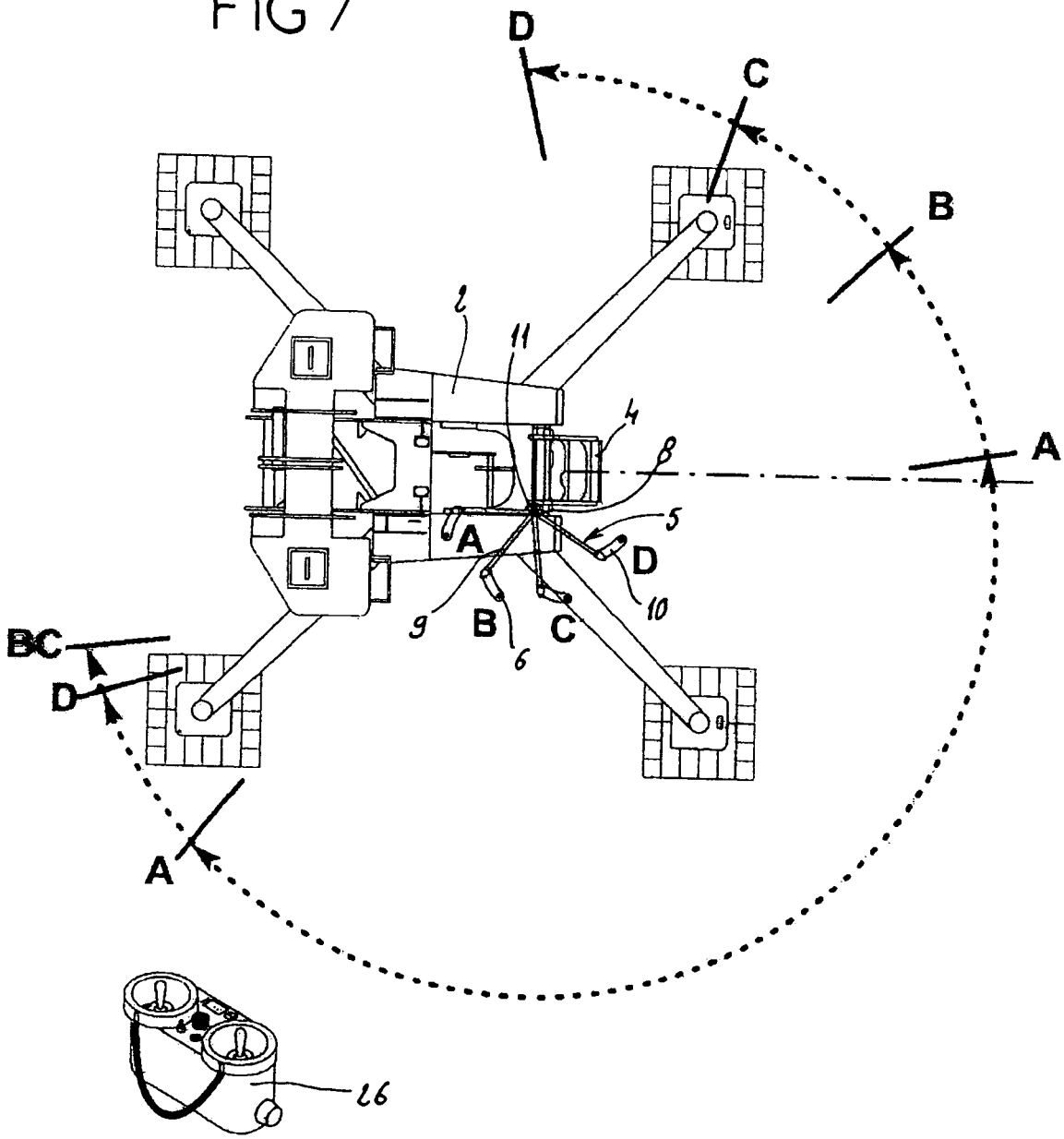
FIG. 7 is a plan view showing a variant of this radio-control antenna support arm, with indication of four exemplary positions.

FIG. 7, in which the components corresponding to those previously described are indicated by the same references, shows a variant of the radio-control antenna 6 support arm 5 which differs from the preceding embodiment principally in that it has four positions, denoted A to D, the structure of the support arm 5 not being essentially modified.

In the first position A, the support arm 5 is folded back against the lateral part of the rotating chassis 2 of the crane. This first position A, locked as before by an upper positioning pin, is used for immobilizing the support arm 5 for transporting the crane and also constitutes a working position, particularly for the orientation of the crane over a 360° range.

The second position B, located at an angular distance of about 60° with respect to the preceding one, is a preferred position for the raising and lowering of the crane.

The third position C, located at an angular distance of about 60° with respect to the preceding one, and therefore at about 120° with respect to the first position A, brings the antenna 6 to the front of the chassis 2. This is a preferred position when the operator is located in front of the crane close to the lifted load.

Finally, the fourth position D, located at an angular distance of about 60° with respect to the preceding one, and therefore at about 180° with respect to the first position A, brings the antenna 6 in front of the mast 4. This last position D is preferred in the case where the operator is located at height on the side of the crane opposite to that of the antenna 6.

FIG. 7 also shows, for each position A, B, C and D, of the support arm 5, the corresponding zones covered without obstacles between the transmitter, that is to say the control unit 26, and the antenna 6 (receiver).

To immobilize the support arm 5 in the three positions B, C and D, each of which is separated from the chassis 2, a single lower fixing pin is still used, which in the present case can be inserted in one of the three holes drilled in the plate integral with the fixed pivot 8, these three holes being drilled on a same circle centered on the vertical pivoting axis 11 of the support arm 5.

None of the following variations would fall outside of the scope of the invention as defined in the appended claims:

- modification of the number of possible positions of the support arm;
- distributing these positions over a bigger or smaller angular range and with bigger or smaller angular distances between them, the angular positional range of the support arm being able to be any range whatsoever up to a possibility of orientation of this support arm over 360°;

insofar as it is a tubular support arm, producing it in the form of a telescopic arm with a system of compensation of the length of the cable passing inside it;

producing the support arm as a deformable arm, in several sections, this variant, like the preceding one, also allowing a height-adjustable positioning of the antenna;

having two or more antennas, for example a receiving antenna and a separate transmitting antenna, on the head of the support arm;

modifying the constructive details of the pivot and of the positioning means;

applying this antenna support arm to tower cranes of all types, as well as to radio-controlled lifting machinery other than tower cranes, such as mobile cranes, truck cranes, trucks with telescopic arms, lifting platforms, etc.

What is claimed is:

1. A radio-control antenna support device, comprising a support arm that can be pivotally mounted to at least one of a lower frame or a lower chassis of a tower crane, the support arm including a head upon which is mounted at least one radio-control antenna for radio control of the tower crane, wherein the head is radially offset from a vertical pivoting axis of the support arm, and the support arm can be oriented about the vertical pivoting axis and can be positioned in at least two separate angular positions.

2. The radio-control antenna support device as claimed in claim 1, the support arm further comprising:

a base part that rotates on a fixed pivot, the fixed pivot defining the vertical pivoting axis;

a curved or bent tube extending from the base part, a transmission cable which ends at the radio-control antenna passing inside the tube; and at least one positioning device that immobilizes the tube in at least one of the at least two separate angular positions, wherein the head is mounted to an end of the tube, and the head forms a mounting plate upon which the radio-control antenna is mounted.

3. The radio-control antenna support device as claimed in claim 1, wherein the at least two separate angular positions in which the support arm can be immobilized, comprise a position folded back against the at least one of the lower frame or lower chassis of the tower crane, and at least one position usable to position the head to be separated from the at least one of the lower frame or lower chassis of tower crane.

4. The radio-control antenna support device as claimed in claim 3, wherein the at least two separate angular positions in which the support arm can be immobilized comprise:

a first position which is the position folded back against the at least one of the lower frame or lower chassis of the tower crane, the first position being usable for the working of the tower crane and also for transporting the tower crane;

a second position, the second position usable to position the head to be separated from the at least one of the lower frame or lower chassis of the tower crane for raising and lowering of the; the tower crane; and at least a third position which is separated from the at least one of the lower frame or lower chassis of the tower crane, for bringing the radio-control antenna at least one of toward or in front of the at least one of the lower frame or lower chassis of the tower crane.

5. The radio-control antenna support device as claimed in claim 4, wherein an angular distance between the first position of the support arm and the second position of the support arm is approximately 60° and an angular distance between the second position of the support arm and the at least one third position of the support arm is also approximately 60°, the support arm thus having an angular positional range of up to approximately 120°.

6. The radio-control antenna support device as claimed in claim 2, further comprising an upper positioning pin held on a plate fixed to the at least one of the lower frame or lower chassis of the tower crane, the upper positioning pin cooperating with another plate, provided with a hole, attached to the head, to position the support arm in a position folded back against the at least one of the lower frame or lower chassis of the tower crane.

7. The radio-control antenna support device as claimed in claim 2, further comprising a lower positioning pin attached to the base part of the support arm at the fixed pivot, the lower positioning pin cooperating with at least one hole in a plate integral with a part of the fixed pivot to position the support arm in at least one position usable to position the head to be separated from the at least one of the lower frame or lower chassis of the tower crane.

8. The radio-control antenna support device as claimed in claim 7, wherein the fixed pivot usable for orientation of the support arm has a U shape with at least two flanges positioned horizontally, one of the at least two flanges positioned vertically above another of the at least two flanges to form at least an upper bearing and a lower bearing, the upper bearing and the lower bearing being traversed by the base part of the support arm, the plate drilled with at least one hole being integral with the one of the at least two flanges that forms the upper bearing.

9. The radio-control antenna support device as claimed in claim 8, wherein the at least two flanges are connected by a vertical section that is fixed with respect to the at least one of the lower frame or lower chassis of the tower crane.

10. The radio-control antenna support device as claimed in claim 6, wherein the base part of the support arm is mounted such that the base part slides along a vertical axis in the fixed pivot to raise the support arm to allow movement of the support arm from one position to another position.

11. The radio-control antenna support device as claimed in claim 10, wherein raising of the support arm facilitates releasing the plate from the upper positioning pin and moving around an obstacle formed by an upper edge of the at least one of the lower frame or lower chassis of the tower crane during movement of the support arm at least from the first position to the second position.

12. The radio-control antenna support device as claimed in claim 10, wherein a stop device is provided on the base part of the support arm to limit the raising of the support arm and to restrict the support arm from coming out of the pivot during a change of position of the support arm.

13. The radio-control antenna support device as claimed in claim 12, wherein the stop device comprises a safety pin.

14. The radio-control antenna support device as claimed in claim 3, further comprising an upper positioning pin held on a plate fixed to the at least one of the lower frame or lower chassis of the tower crane, the upper positioning pin cooperating with another plate, provided with a hole, attached to the head, to position the support arm in the position folded back against the at least one of the lower frame or lower chassis of the tower crane.

15. The radio-control antenna support device as claimed in claim 2, wherein the base part of the support arm is mounted such that the base part slides along a vertical axis in the fixed pivot to raise the support arm to allow movement of the support arm from one position to another position.

16. Tower crane including the radio-control antenna support device of claim 1.

* * * * *